US005608431A

United States Patent [19]

Kishida et al.

[11] Patent Number: 5,608,431

[45] Date of Patent: Mar. 4, 1997

[54] BIDIRECTIONAL INK JET RECORDING HEAD

[75] Inventors: Hideaki Kishida, Yamato; Akira Katayama, Yokohama, both of Japan

[73] Assignee: Canon Kabushiki Kaisha, Tokyo, Japan

[21] Appl. No.: 276,490

[22] Filed: Jul. 18, 1994

Related U.S. Application Data

[63] Continuation of Ser. No. 800,757, Dec. 2, 1991, abandoned, which is a continuation of Ser. No. 513,869, Apr. 24, 1990, abandoned.

[30] Foreign Application Priority Data

Apr. 24, 1989 [JP] Japan ..... 1-103976

[51] Int. Cl.[6] ..... B41S 2/07

[52] U.S. Cl. ..... 347/13

[58] Field of Search ..... 347/12, 13, 237, 347/145, 180, 182; 346/76 PH, 139 C, 154; 219/216

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,520,373 | 5/1985 | Ayata et al. . | |
| 4,536,778 | 8/1985 | De Schamphelaere et al. | 346/160 |
| 4,558,333 | 12/1985 | Sugitani et al. | 346/140 R |
| 4,571,602 | 2/1986 | De Schamphelaere et al. | 346/160 |
| 4,639,747 | 1/1987 | Sakurada et al. | 346/140 R |
| 4,651,164 | 3/1987 | Abe et al. | 346/76 PH |
| 4,709,244 | 11/1987 | Piatt et al. | 346/140 R |
| 4,723,129 | 2/1988 | Endo et al. | 346/1.1 |
| 4,740,796 | 4/1988 | Endo et al. | 346/1.1 |
| 4,746,941 | 5/1988 | Pham et al. | 346/154 X |
| 4,750,010 | 6/1988 | Ayers et al. | 358/298 X |
| 4,829,324 | 5/1989 | Drake et al. | 346/140 R |
| 4,835,549 | 5/1989 | Samejima et al. | 346/76 PH |
| 4,841,120 | 6/1989 | Yagino et al. | 219/216 |
| 4,851,923 | 7/1989 | Abe et al. . | |
| 4,872,027 | 10/1989 | Buskirk et al. | 346/140 R |

FOREIGN PATENT DOCUMENTS

| | | |
|---|---|---|
| 0130612 | 1/1985 | European Pat. Off. . |
| 54-56847 | 5/1979 | Japan . |
| 58-187370 | 11/1983 | Japan . |
| 59-123670 | 7/1984 | Japan . |
| 59-138461 | 8/1984 | Japan . |
| 60-71260 | 4/1985 | Japan . |

*Primary Examiner*—Benjamin R. Fuller
*Assistant Examiner*—David Yockey
*Attorney, Agent, or Firm*—Fitzpatrick, Cella, Harper & Scinto

[57] ABSTRACT

A driving integrated circuit for a recording head, is carried on the recording head on which a plurality of recording elements are mounted. The recording elements are selectively driven in accordance with an input recording data signal and a control signal. At least a portion of transmission paths of the input recording data signal and the control signal has bidirectivity.

14 Claims, 9 Drawing Sheets

BIDIRECTIONAL INK JET RECORDING HEAD

This application is a continuation of application Ser. No. 07/800,757 filed Dec. 2, 1991, now abandoned, which is a continuation of application Ser. No. 07/513,869 filed Apr. 24, 1990, abandoned.

BACKGROUND OF THE INVENTION

1. Field of the Invention

The present invention relates to a recording head, an integrated circuit for driving the head, a circuit board for the head, and a recording apparatus and, more particularly, to those suitably applied to a recording head such as an ink-jet recording head, a heat-sensitive recording head, thermal head, or the like, which performs recording by utilizing heat produced by a resistor or the like, an integrated circuit for driving the head, a circuit board for the head, and a recording apparatus.

2. Related Background Art

Conventionally, a recording system for performing recording by utilizing heat energy has advantages such as very low noise output since it is a non-impact recording system, allowing an elongated structure by arraying a large number of recording elements, and the like. In recent years, the recording system of this type has received attention since it can be easily applied to a color recording system.

In particular, an ink-jet recording apparatus which utilizes heat as energy for forming an emission droplet can easily realize a high-density multi-nozzle structure. Thus, the ink-jet recording apparatus has a great advantage in that a high-resolution, high-quality image can be obtained at high speed.

In an ink-jet recording apparatus of this type, a plurality of droplet forming means for emitting ink droplets from emission ports upon application of heat energy to the ink, i.e., droplet forming means having electrothermal conversion elements which are heated upon reception of current pulses and can heat the ink, and a plurality of integrated circuits (driving ICs) for driving the electrothermal conversion elements are arranged on a single circuit board, thus constituting a recording head for a line printer, i.e., a so-called full-multi type recording head in which emission ports are arrayed over the total width of a recording medium.

FIG. 1 shows an electrical arrangement of an ink-jet recording head of this type, and FIG. 2 shows its driving timings. Recording data (SI), the number of bits of which correspond to the number of electrothermal conversion elements 7, are sequentially transmitted to shift registers 4 in driving ICs 3 in synchronism with a data transmission clock (CLK). After all the data are input, the input data are latched by latch circuits 5 in response to a latch signal (LAT). Thereafter, according to a divisional driving signal (EI) and a divisional driving signal transmission clock (ECK), the driving ICs 3 are sequentially enabled by flip-flops (F/F) 6, and the electrothermal conversion elements 7 whose recording data signals are ON are selectively energized during only an ON period of a pulse-width setting signal (ENB), thereby emitting droplets.

In a recording apparatus of this type, a data transmission direction of a recording data signal and a control signal is determined to be one direction. Therefore, when a mounting direction of a recording head is to be reversed, i.e., then the recording head is mounted at a position rotated through 180° in a plane opposing a recording medium, new driving ICs must be manufactured, or the format of the data signal must be reconstructed in a reverse direction.

A case will be considered below wherein color recording is performed by an array of a large number of recording heads. An apparatus of this type ordinarily employs a divisional driving system in which emission ports are divided into blocks each including a predetermined number of ports, and heads are driven in units of blocks. In this system, the recording heads are mounted in the same direction to prevent dot offsets caused by shifted emission timings in the divisional driving mode and to have the same correspondences between color data and dot positions. However, in order to meet recent requirements of a compact recording apparatus, a demand has arisen for a structure which has a margin in mounting directions of heads. More specifically, in an arrangement wherein recording heads are mounted on the upper and lower surfaces of a single base plate to constitute a head unit, and, for example, two-color recording is performed by the head unit, a larger space can be advantageously assured as compared to a case wherein the heads are mounted on separate base plates.

In this case, however, the heads on the upper and lower surfaces have apparently opposite signal transmission directions, and a problem of dot offsets in the divisional driving mode may be posed. For example, assume that a recording apparatus comprises two arrays of recording heads each having emission ports aligned over a range corresponding to the total width of a recording medium, and performs divisional driving in the respective recording head while continuously conveying the recording medium. Steps having small stepped portions appear in a 1-line image due to divisional driving and continuous conveyance. However, as shown in FIG. 3, the steps appear in opposite directions since first and second heads have apparently opposite divisional driving directions. Thus, recording positions of upper and lower heads are offset from each other, and recording positions of upper and lower blocks overlap each other, resulting in color nonuniformity. In order to prevent this, two types of heads having different transmission directions are necessary, resulting in an economical disadvantage.

U.S. Pat. Nos. 4,463,359 and 4,520,373 disclose ink jet recording apparatuses wherein small recording heads are complementarily and alternately disposed at both sides of a common substrate, so as to constitute a full line recording head corresponding to the recording width along a conveying direction of the recording medium. These structures have an advantage in that a full line recording head can be readily obtained. They disclose a facsimile apparatus or copier wherein an original is read and information to be recorded is transmitted. However, they only disclose that time divisional driving is conducted equally for each small recording head, and that odd and even orders of the small recording heads are driven relating to a relative distance therebetween. As the reading means, a reading mechanism, wherein plurality of CCD's are disposed, such as a full line type 1 is disclosed. But, there is no disclosure concerning a concrete direction of a reading and a data transmission between a memory buffer and the recording head.

In case of an apparatus using reading means conducting reading for plural directions when the recording direction is fixed, it is necessary to change the address of reading data to be stored, or to change the address of the data supplied from the memory before driving the recording head. A structure for performing such address change operation would be complex.

Accordingly, in case of plural reading directions (i.e., bidirectional reading), it is important that the recording (data transmission) direction of each recording head constituting the full line head like ones disclosed in the above described U.S. Patents is adapted to the bidirectional high speed reading without increasing cost. Further, in case of a color recording wherein plural full line heads are disposed, it it important to achieve a high speed color recording without degrading image quality due to degrading of the color reproduction property and to recording position misalignment.

SUMMARY OF THE INVENTION

The present invention has been made in consideration of the above situation, and has as its object to realize a circuit board for a recording head which can drive recording heads using a single signal format regardless of mounting directions of recording heads by a simple method, thereby decreasing the cost of a recording apparatus and improving recording quality.

For this purpose, according to the present invention, a driving integrated circuit for a recording head is characterized in that the driving integrated circuit is carried on the recording head on which a plurality of recording elements are mounted, selectively drives the recording elements in accordance with an input recording data signal and a control signal, and at least a portion of transmission paths of the input recording data signal and the control signal has bidirectivity.

Moreover, a recording head circuit board is characterized by carrying a driving integrated circuit, on which a plurality of recording elements are arranged, for selectively driving the recording elements in accordance with an input recording data signal and a control signal, wherein at least a portion of transmission paths of the input recording data signal and the control signal has bidirectivity.

Furthermore, a recording head having a circuit board is characterized by carrying a driving integrated circuit, on which a plurality of recording elements are arranged, for selectively driving the recordings elements in accordance with an input recording data signal and a control signal, wherein at least a portion of transmission paths of the input recording data signal and the control signal has bidirectivity.

In addition, a recording apparatus is characterized by having a recording head having a circuit board which carries a driving integrated circuit, on which a plurality of recording elements are arranged, for selectively driving the recording elements in accordance with an input recording data signal and a control signal, wherein at least a portion of transmission paths of the recording data signal and the control signal input to the recording head has bidirectivity.

According to the present invention, since some or all recording data signals have bidirectivity, a signal transmission direction of recording data and a control signal can be switched.

A further object of the present invention is to provide a recording apparatus of high speed data processing recording comprising reading means for bidirectional reading and a memory buffer for bidirectional data transmissions, wherein, at least a recording head for conducting the recording secondary or following to the secondary recording has a bidirectional operation circuit included within at least a portion of a transmission path of an input recording data and a control signal, so as to adapt to a high speed data processing.

It is desirable to provide a plurality of full line recording heads, a full line recording head comprising a plurality of small recording heads, or the like with the bidirectional operation so as to align the operation with the transmission direction within the recording head to which the recording signal is first supplied, and so as to align the transmission direction of each recording head to which subsequent recording signals are supplied. The recording heads may be cooperated to align the transmission direction.

BRIEF DESCRIPTION OF THE DRAWINGS

FIG. 8A is a block diagram, FIG. 8B shows a concept of switching the transmission direction of each recording head.

DETAILED DESCRIPTION OF THE PREFERRED EMBODIMENTS

An embodiment of the present invention will be described in detail below with reference to the accompanying drawings.

Figure 1:
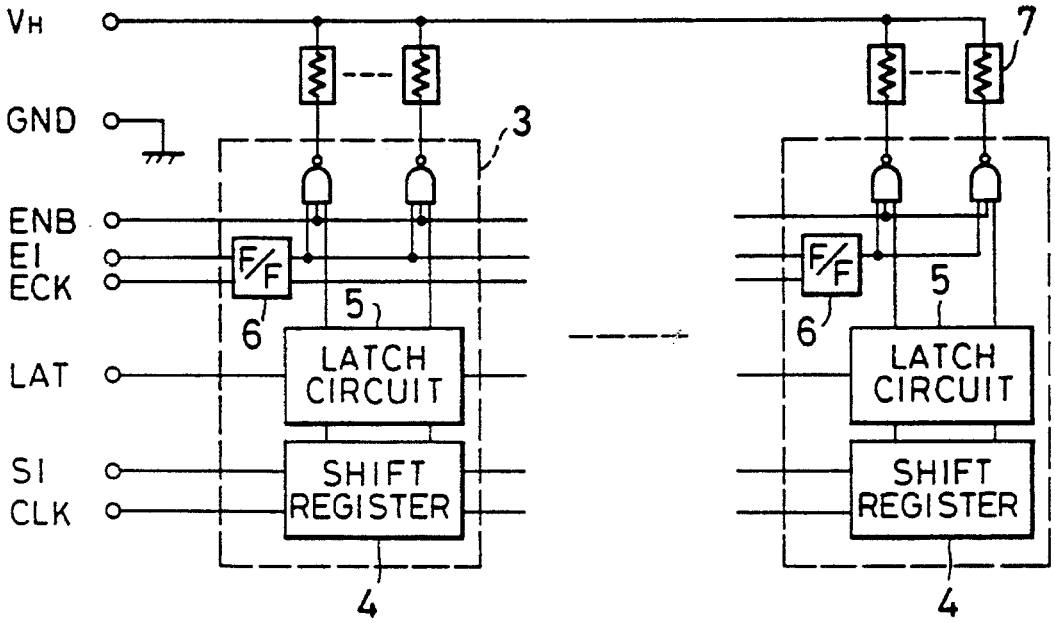
FIG. 1 PRIOR ART
FIG. 1 is a block diagram showing an electrical arrangement of a conventional recording head.
Figure 2:
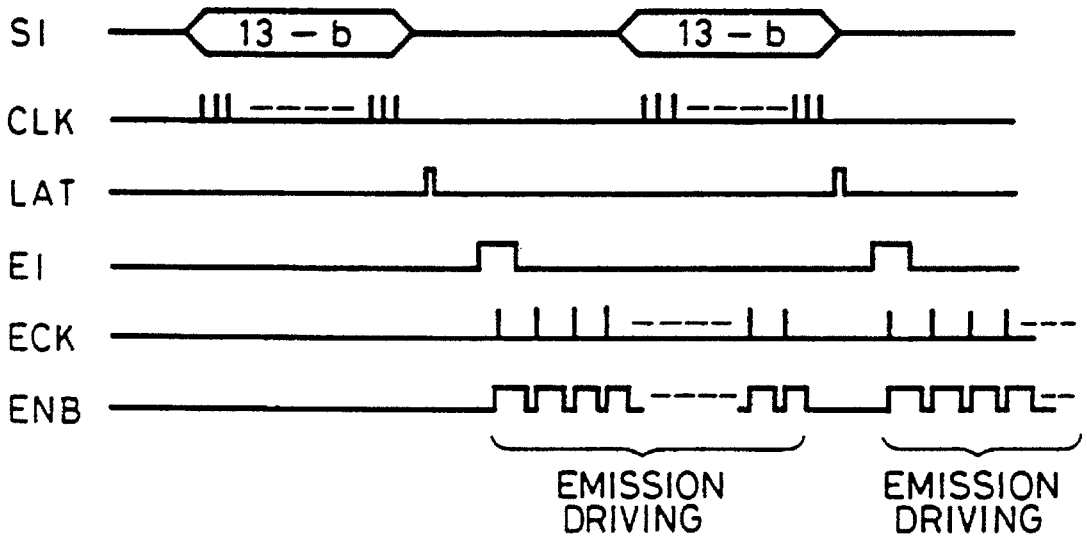
FIG.2 PRIOR ART
FIG. 2 is a timing chart showing driving timings of the recording head.
Figure 3:
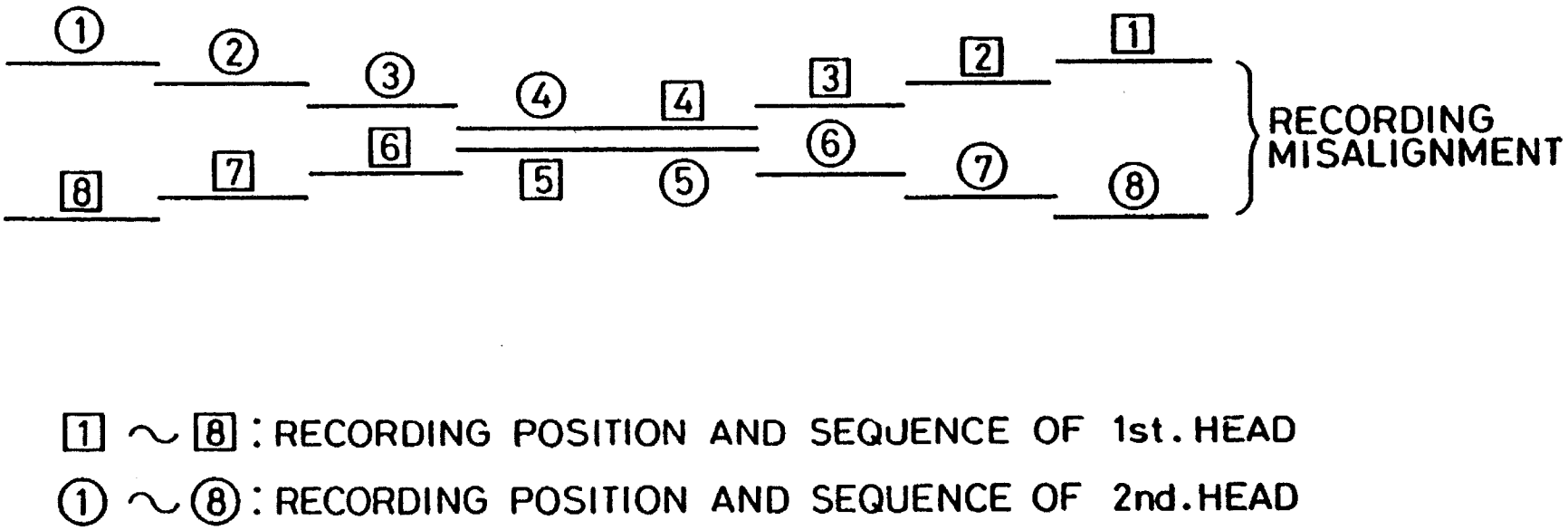
FIG.3 PRIOR ART
FIG. 3 is a view for explaining problems posed when two recording heads having apparently different signal transmission directions are divisionally driven.
Figure 4A:
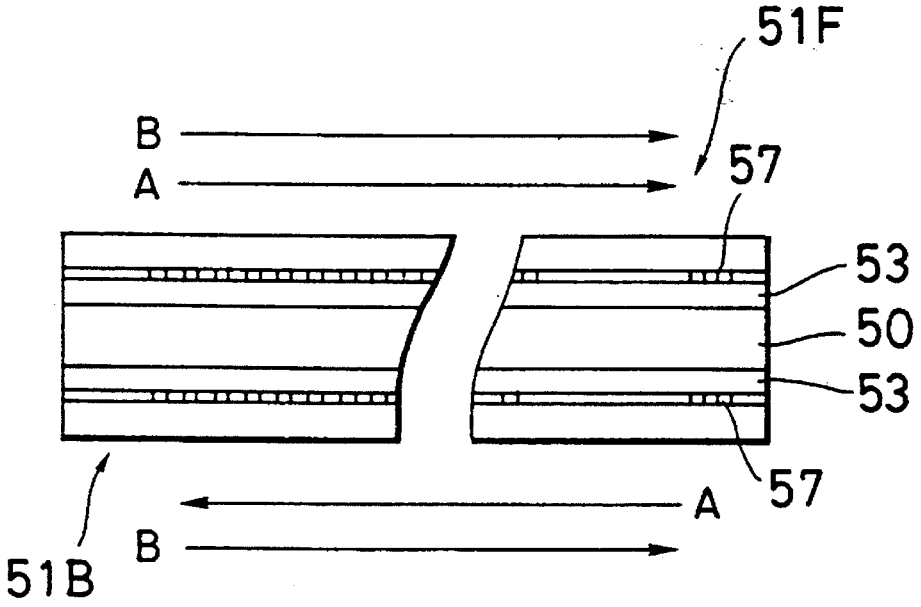
FIGS. 4A and 4B are a front view and a sectional view showing an arrangement of an ink-jet recording head unit to which the present invention can be applied.
Figure 4B:
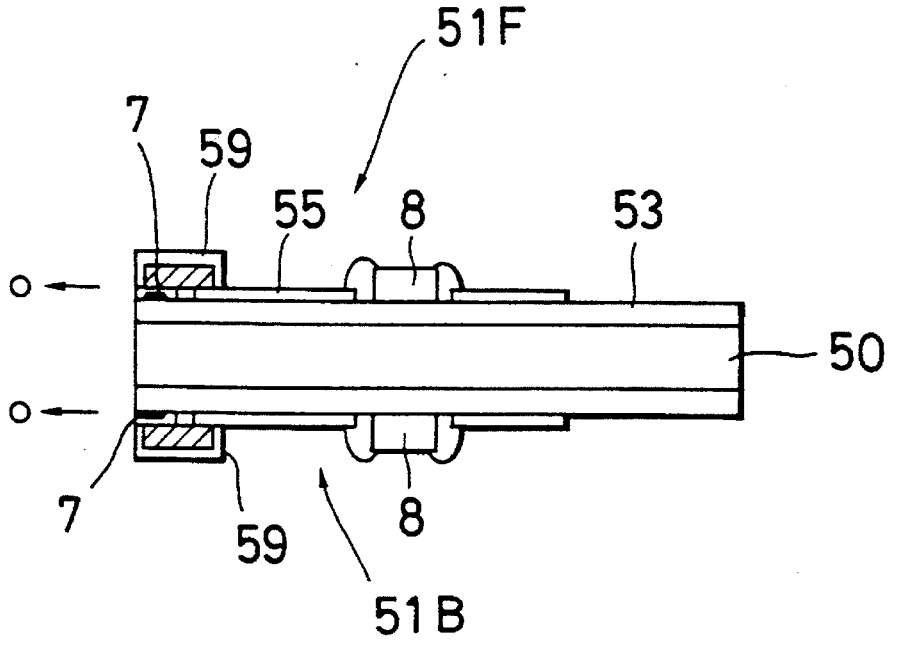

FIGS. 4A and 4B are respectively a front view and a sectional view of an ink-jet recording head unit according to an embodiment of the present invention. Reference numeral 50 denotes a base plate, on the upper and lower surfaces of which recording heads 51F and 51B are arranged. Each recording head has a head circuit board 53. Electrothermal conversion elements 7, a wiring unit 55, a partition wall unit for forming ink paths and emission ports 57, and driving ICs 8 are arranged on the head circuit board 53. Reference numeral 59 denotes a top plate which is coupled to the head circuit board 53 to form the emission ports 57, ink paths communicating with the ports, a common ink chamber for introducing an ink to the ink paths, and the like.

In a structure where the recording heads have opposite mounting directions in this manner, if they have the same electrical data transmission direction, data transmission or divisional driving is performed for the heads in the direction of arrows A. Thus, the heads have apparatus opposite data transmission directions or driving directions in a divisional driving mode. As a result, dot offsets easily occur in the divisional driving mode. In order to prevent this, opposing electrical data transmission directions or divisional driving directions are preferably set, so that these directions seem to be the same direction, as indicated by an arrow B. Thus, the recording heads that can operate bidirectionally are said to have bidirectivity. In this example recording head 51B is driven bidirectionally, that is, in the direction of arrow A or arrow B.

In this embodiment, the driving ICs 8 have the same arrangement to cope with different head mounting directions, thereby simplifying manufacturing processes of the driving ICs, a circuit board carrying these ICs, recording heads or a head unit using the circuit board, and an ink-jet recording apparatus.

Figure 5A:
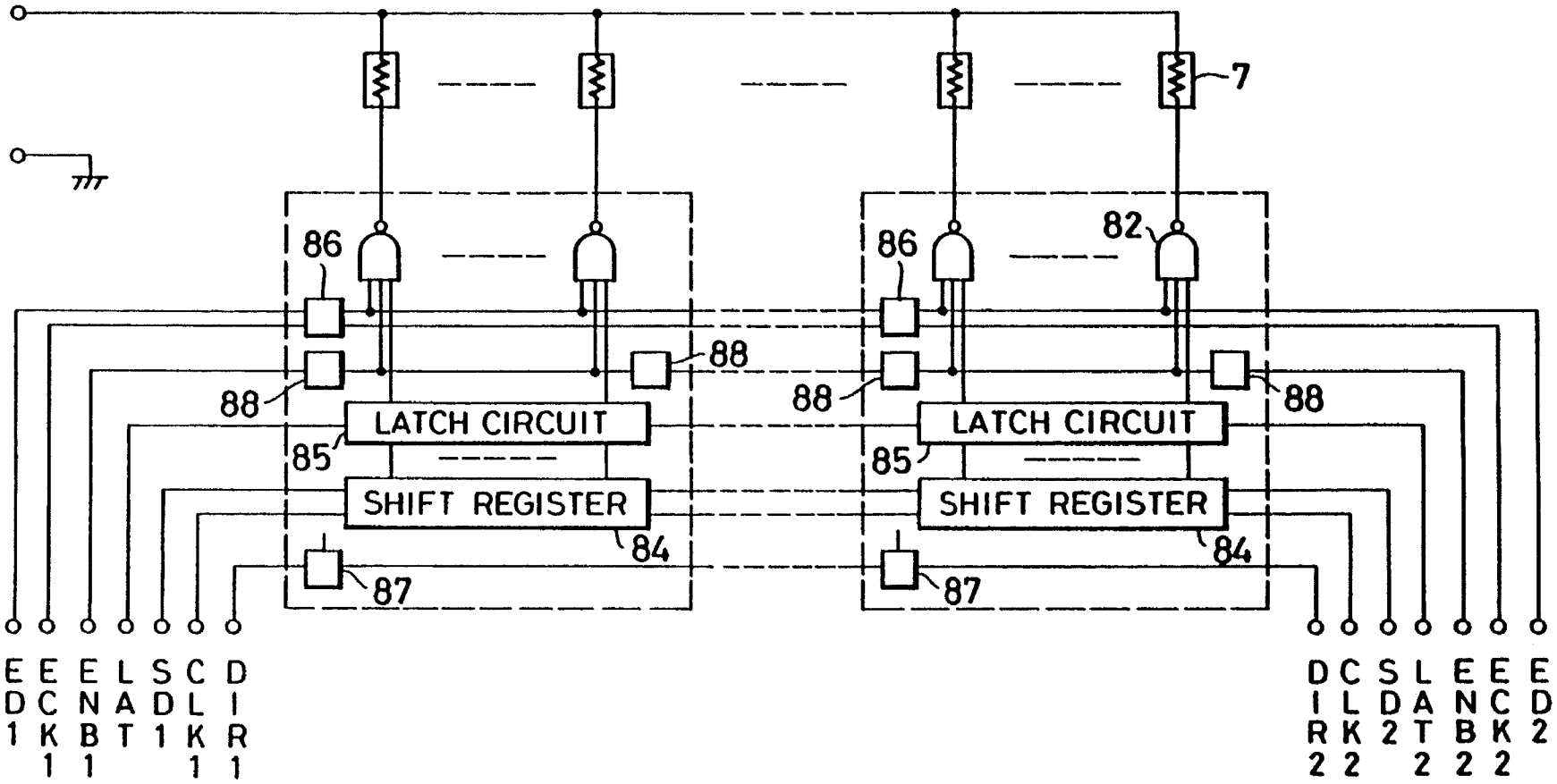
FIGS. 5A and 5B are block diagram showing an electrical arrangement of a head circuit board according to an embodiment, and a circuit diagram showing a detailed arrangement of a driving IC therefor, respectively.
Figure 5B:
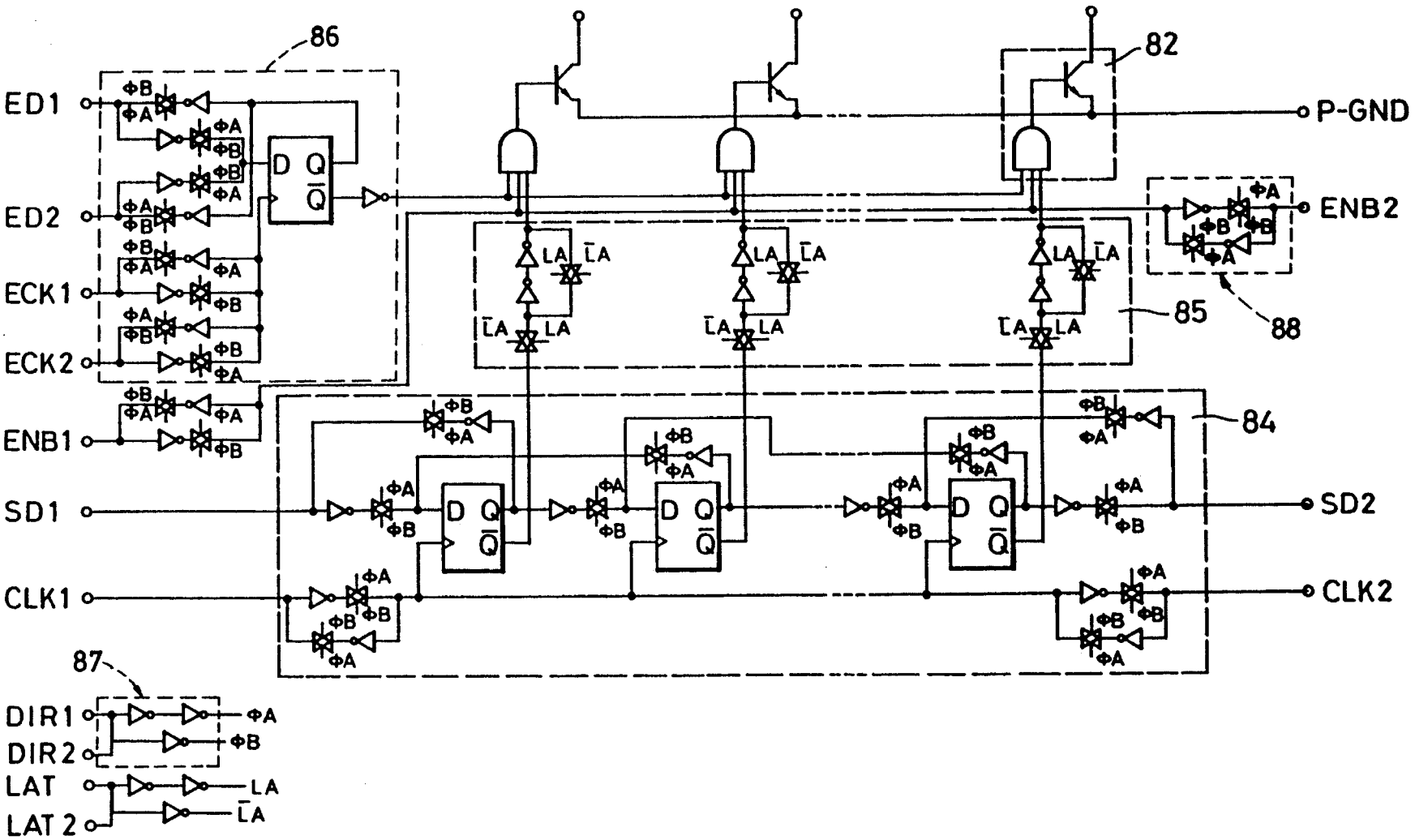

FIGS. 5A and 5B respectively show the detailed electrical arrangements of the head circuit board 53 and the driving IC 8 according to this embodiment. Recording data SD1 or SD2, the number of bits of which correspond to the number of electrothermal conversion elements 7, are sequentially transmitted via recording data signals to shift registers 84 in the driving ICs 8 in synchronism with a data transmission clock (CLK1 or CLK2). After all the data are input, the input data are latched by latch circuits 85 in response to a latch signal (LAT1 or LAT2). Thereafter, according to a divisional driving signal (ED1 or ED2) and a divisional driving signal transmission clock (ECK1 or ECK2), the driving ICs 8 are sequentially enabled by D flip-flops (F/F) 86, and the electrothermal conversion elements 7 whose recording data signals are ON are selectively energized through driving elements 82 during only an ON period of a pulse-width setting signal (ENB1 or ENB2), thereby emitting droplets. Reference numerals 87 and 88 denote signal transmission direction control units.

A signal input/output (I/O) terminal of each driving IC 8 of this embodiment has bidirectivity, and an I/O direction is switched by switching a signal DIR1 or DIR2 between "H" and "L" levels. The input/output terminals input either one signal of each pair of control signals, such as ED1 or ED2, ECK1 or ECK2, ENB1 or ENB2, LAT1 or LAT2, and CLK1 or CLK2, depending on the I/O direction. The internal shift registers 84 have bidirectivity in units of bits, and constitute n stages of shift registers. The driving ICs 8 according to this embodiment are arranged on the circuit board 53 on which the plurality of electrothermal conversion elements 7 are arranged and wirings are made, and are connected thereto by wire bonding, flip-chip, tape carrier bonding, or the like. The signal terminals of the driving ICs 8 are connected in series with each other, and the I/O terminals are arranged on two sides of the circuit board 53. The I/O direction of each signal terminal is switched by switching the signal DIR1 (or DIR2) between "H" and "L" levels. For example, if it is selected that signals added with "1" at their ends, e.g., SD1, CLK1, and the like are input side signals, recording data are transmitted from the SD1 side to the SD2 side, and divisional driving is sequentially performed from the ED1 side. When an opposite direction is selected, recording data are transmitted from the SD2 side to the SD1 side, and divisional driving is sequentially performed from the ED2 side.

In this embodiment, divisional driving is performed in units of driving ICs. However, the number of divisions, and another driving method may be desirably selected, as a matter of course.

Figure 6:
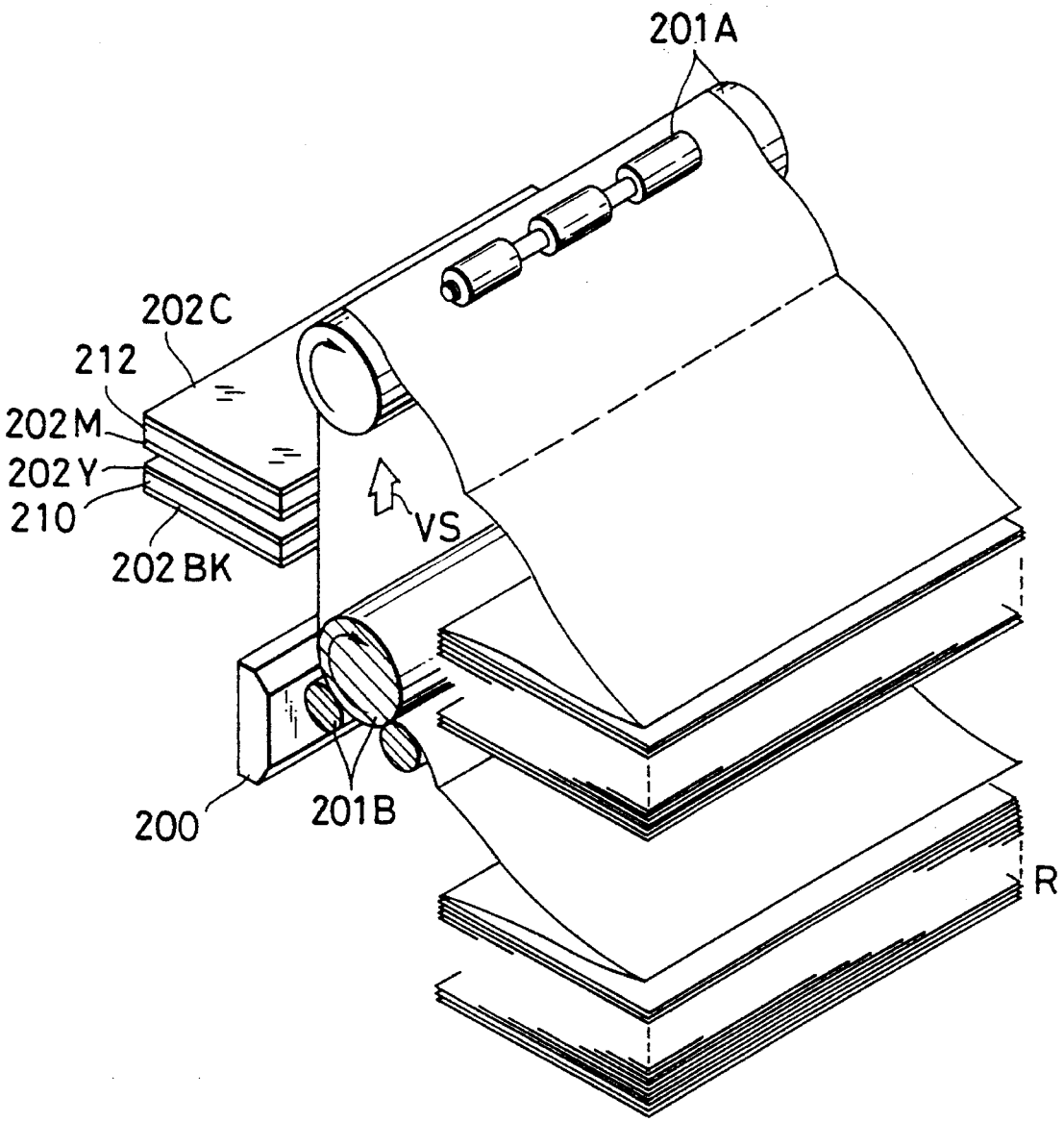
FIG. 6 is a perspective view showing an embodiment of an ink-jet recording apparatus constituted by using the recording heads shown in FIGS. 4A and 4B.

Using the recording heads and their driving systems described above, a line printer capable of full-color recording, as shown in FIG. 6 can be arranged.

In FIG. 6, reference numerals 201A and 201B denote rollers which are arranged to clamp and convey a recording medium R in a sub scanning direction $V_s$. Reference numerals 202BK, 202Y, 202M, and 202C denote full-multi type recording heads which perform black, yellow, magenta, and cyan recording operations over the total width of the recording medium R, and are arranged in the order named from the upstream side of the recording medium convey direction. The heads 202Y and 202BK are arranged on the upper and lower surfaces of a base plate 210, and the heads 202C and 202M are arranged on the upper and lower surfaces of a base plate 212.

Reference numeral 200 denotes a recovery system, which opposes the recording heads 202BK to 202C in place of the recording medium R in emission recovery processing.

In the above arrangement, a circuit type of a driving IC can be arbitrarily determined to be, e.g., a bipolar type, MOS type, or BiCMOS type. The head structure is not limited to the full-multi type described above, and may be a structure allowing serial scanning.

Figure 7A:
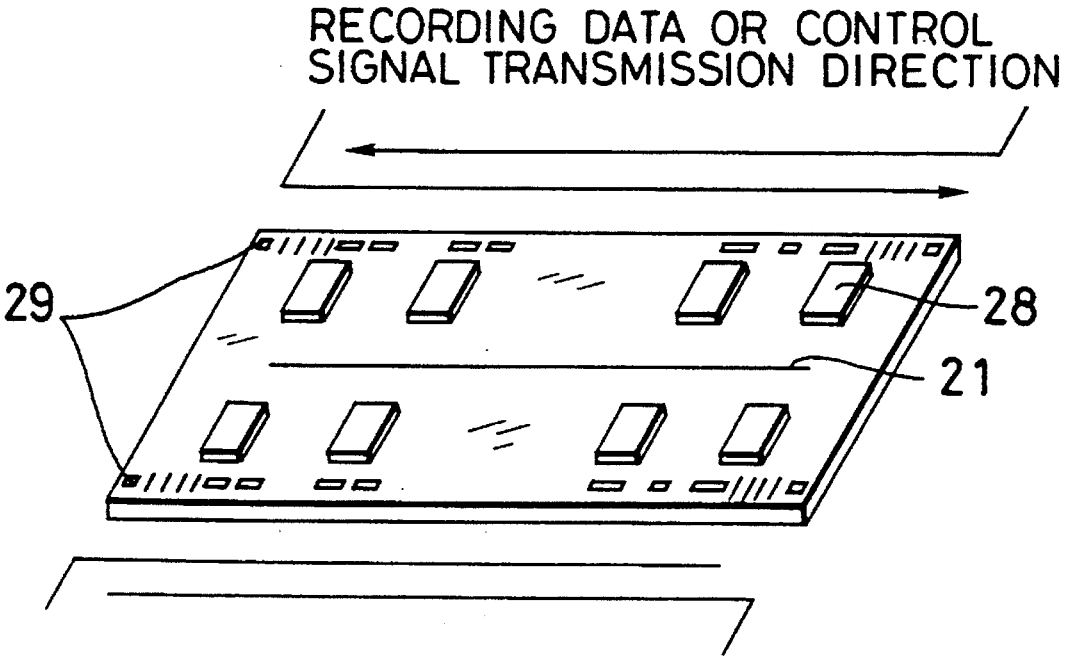
FIGS. 7A and 7B are perspective views showing other embodiments of recording heads to which the present invention can be applied.
Figure 7B:
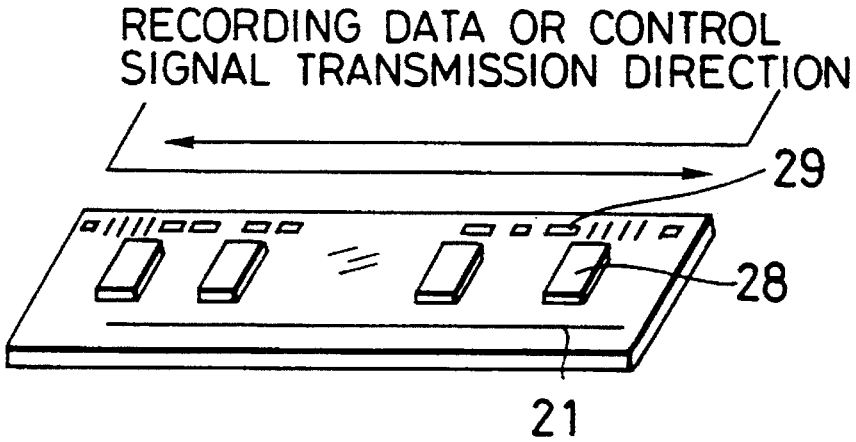

The present invention can be effectively and easily applied not only to an ink-jet recording head in the above embodiment, but also to a thermal head shown in FIG. 7A or 7B. In FIGS. 7A and 7B, reference numeral 27 denotes electrothermal conversion elements as recording elements; 28, driving ICs; and 29, terminals. With this arrangement, when the driving ICs have the same arrangement as that shown in FIGS. 5A and 5B a transmission direction can be appropriately determined with respect to recording data or a control signal, and the degree of freedom of mounting directions can be increased.

As described above, according to the present embodiment, since an I/O direction of recording data or a control signal, can be easily changed, a recording apparatus which can drive recording heads having different mounting directions in apparently the same signal transmission direction regardless of the head mounting directions, and have a low cost and high recording quality can be realized.

Figure 8A:
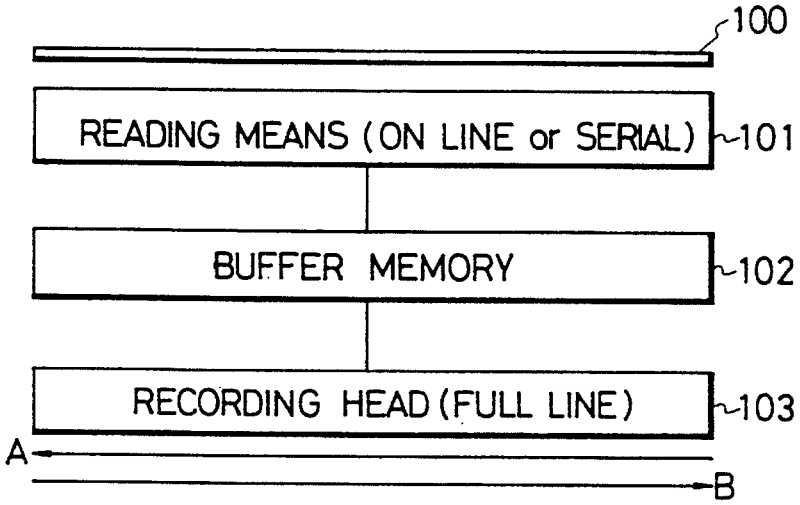
FIGS. 8A and 8B are schematic views showing a structure of the recording apparatus with reading means according to further embodiment of the present invention.
Figure 8B:
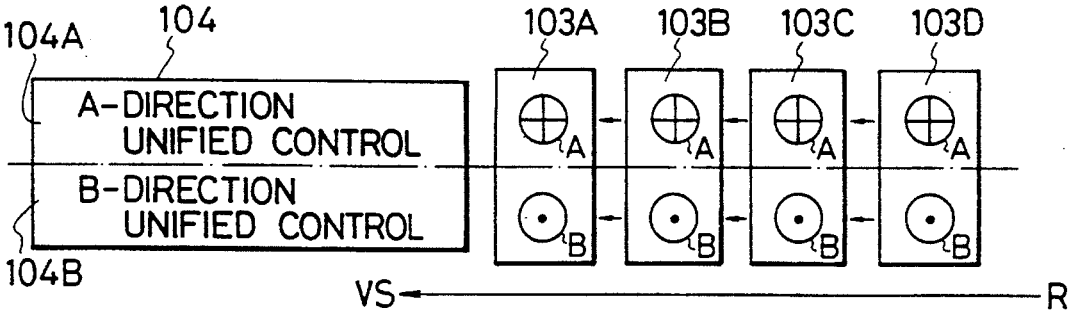

Referring to FIGS. 8A and 8B, 100 denotes an original with an image to be recorded, 101 denotes a reading means. In the present embodiment, full line or serial type reading means may be used. It should have plural reading directions. In FIGS. 8A and 8B, in which reading in right and left direction can be achieved, 102 is buffer memory which temporary stores an image data from the reading means and transmits them in the inputted order. Accordingly, the recording head 103 should achieve recording on the basis of the recording data transmitted in the direction along the reading direction by the reading means 101.

According to the present embodiment, as shown in FIG. 8B, full line recording heads 103A, 103B, 103C, and 103D for different recording colors are disposed subsequently from down stream to up stream along conveying direction VS of the recording medium R. Since all of recording heads 103A–103D have bidirectional property at transmission paths of input recording data signals and control signals, the recording directions can be aligned to A or B in the order of reading by the reading means 101. A device 104 systematically controls the bidirectional transmission paths so that all of the recording directions of the recording heads 103A–103D are aligned to A (or B) according to the reading means. Thereby, the above problem is solved. A color image without misalignment of the recordings can be reproduced.

Further, in FIG. 8B, 104A denotes a control block performing alignment in A direction recording order and 104B denotes a control block performing alignment in B direction recording order. When the recording direction of the recording head 103 first conducting recording on the recording medium is aligned to A, these control blocks 104A and 104B, align all of the recording directions of the recording heads 103C, 103B and 103A to A. Even though there is a partial recording region, a recording direction for which is changed from A to B, during the recording operation, all of the recording direction of the recording heads 103A–103D are aligned to B. Therefore, no color disturbance due to misaligned recording would be produced.

The present invention brings about an excellent effect particularly in a recording head and a recording apparatus of the bubble jet type proposed by Canon Kabushiki Kaisha among the ink jet recording types.

As regards the typical construction and principle thereof, it is preferable to use the basic principle disclosed, for example, in U.S. Pat. No. 4,723,129 or U.S. Pat. No. 4,740,796. This system is applicable to both of the so-called on-demand type and the so-called continuous type recording method. In the former case, it is particularly effective because at least one driving signal corresponding to recording information and providing a rapid temperature rise exceeding nuclear boiling is applied to an electro-thermal converting member correspondingly to a sheet or a liquid path retaining liquid (ink) therein, whereby heat energy is generated in the electro-thermal converting member and film boiling is caused on the heat-acting surface of a recording head with a result that a bubble in the liquid (ink) can be formed in one-to-one correspondence to said driving signal. By the growth and contraction of this bubble, the liquid (ink) is discharged through a discharge opening to form at least one droplet. If this driving signal is in the form of a pulse, the growth and contraction of the bubble will take place appropriately on the spot and therefore, discharge of the liquid (ink) which is particularly excellent in responsiveness can be accomplished, and this is more preferable. As the driving signal in the form of a pulse, one as described in U.S. Pat. No. 4,463,359 or U.S. Pat. No. 4,345,262 is suitable. If the conditions described in U.S. Pat. No. 4,313,124 which discloses an invention relating to the temperature rise rate of said heat-acting surface are adopted, more excellent recording can be accomplished.

As the construction of the recording head, besides the construction comprising a combination of discharge openings, liquid paths and electro-thermal converting members as disclosed in each of the above-mentioned patents (the straight liquid flow path or the right-angled liquid flow path), a construction using U.S. Pat. No. 4,558,333 or U.S. Pat. No. 4,459,600 which discloses a construction in which the heat-acting portion is disposed in a bent area is also covered by the present invention. In addition, the present invention is effective for a construction based on Japanese Laid-Open Patent Application No. 59-123670 which discloses a construction in which a slit common to a plurality of electro-thermal converting members is the discharge portion of the electro-thermal converting members, and a construction based on Japanese Laid-Open Patent Application No. 59-138461 which discloses a construction in which an opening for absorbing the pressure wave of heat energy corresponds to the discharge portion.

Further, the present invention is applicable to the full-line type recording head having a length corresponding to the width of the largest recording medium on which the recording apparatus can effect recording. Such recording head may have a construction in which the length is satisfied by a combination of a plurality of recording heads or a construction which is integrally formed of a single recording head.

Further, the present invention can be applicable to a serial type recording head, such as one fixed to an apparatus body, an exchangeable chip type in which the electrical connection with and ink supplying path from the apparatus body are made in its mount on the apparatus body, and the cartridge type recording head provided with an ink tank integrally with the recording head.

Also, the addition of recovery means, preliminary auxiliary means, etc. to the recording head which are provided as the construction of the recording apparatus of the present invention can better stabilize the effect of the present invention, and therefore is preferable. Specifically, they include capping means, cleaning means and pressurizing or suction means for the recording head, an electro-thermal converting member or a heating element discrete therefrom or preliminary heating means comprising a combination of these, and it is also effective for accomplishing stable recording to perform the preliminary discharge mode in which discharge discrete from recording is effected.

Further, the recording mode of the recording apparatus is not limited to the recording mode of the main color such as black, but the present invention is also very effective for an apparatus provided with at least one of a plurality of different colors or full color by a color mixture, though this may be accomplished by constructing the recording head as a unit or employing a combination of a plurality of recording heads.

Further, according to the present embodiments as described in the above, the ink is referred to as the liquid, an ink which is solidified within a room temperature range and is softened or melted above or within the room temperature range may be used. In general, according to the ink jet recording system, the ink temperature is controlled within the range from 30° C. to 70° C., in order to obtain a viscosity of the ink suitable for stable ink emission. Therefore, any ink can be used, if it would melt according to the temperature control responsive recording operation signal supplying. In addition, an excessive temperature increase due to the thermal energy may be prevented by energy consumption due to state transition from solid to liquid. In order to prevent an evaporation of the ink, an ink solidified when in an unused state may be used. In any event, the present invention can be used in case of using the ink such as one which is melted responsive to supplying the thermal energy recording signal and is emitted, and the other which is melted first by the thermal energy and solidified when it reaches the recording medium. The ink of such cases may be retained, at a liquid state or solid state, in a concave portion or holes of porous sheet opposite to the electro-thermal transducer as disclosed in Japanese Laid-Open Patent Applications 54-56847 and 60-71260. Within a scope of the present invention, a most effective type for each ink is one conducting film boiling.

Further, as a configuration of the ink jet recording apparatus of the present invention may be one for use in an image output terminal of an information processing apparatus such as a computer, a copier combined with a reader, and facsimile apparatus for transmitting and receiving.

We claim:

1. An ink jet recording head for recording in response to an inputted driving direction control signal indicating an input direction, said recording head comprising:

a pair of recording units provided on opposite sides of a base plate, each one of said pair of recording units comprising:

a plurality of recording elements for discharging ink onto a recording medium, said recording elements comprising heat generating elements for generating heat energy to emit ink for recording, ink paths and emission ports, said emission ports communicating with said ink paths for directing emitted ink onto the recording medium, a driving integrated circuit having a transmission path for inputting serially an input recording data signal, and a shift register for serially inputting the input recording data signal through said transmission path in a sequence and for supplying the recording signal in parallel to said plurality of recording elements, wherein said transmission path is switchable between a first state in which said transmission path transmits the recording data to said shift register in a first direction in an order of an alignment of said recording elements and a second state in which said transmission path transmits the recording data to said shift register in a second direction opposite to the first input direction, controlling driving of direction control means for controlling driving of said plurality of recording elements, according to the inputted driving direction control signal, bidirectionally in an order along the input direction of the driving direction control signal, and time divisional driving means for driving sequentially the plural recording elements in predetermined units of plural elements according to the input direction of the driving direction control signal, wherein ink droplets discharged in a same recording line from two corresponding emission ports of said pair of recording units are deposited onto substantially a same locus.

2. An ink jet recording head according to claim 1, further comprising a latch circuit and bidirectional signal input/output terminals operating as input and output terminals performing bidirectional transfer to be supplied to the latch circuit.

3. An ink jet recording head according to claim 1, wherein said driving integrated circuit further comprises a latch circuit and bidirectional signal input/output terminals operating as input and output terminals performing bidirectional transfer to be supplied to the latch circuit.

4. An ink jet recording head according to claim 2, further comprising transmission direction control means for switching an input/output direction of the signal terminals.

5. An ink jet recording head circuit board according to claim 3, wherein said driving integrated circuit further comprises transmission direction control means for switching an input/output direction of the signal terminals.

6. An ink jet recording head according to claim 1, further comprising a plurality of driving integrated circuits serially connected by way of the transmission path.

7. An ink jet recording head according to claim 2, wherein said terminals that operate as input and output terminals are for input and output to the transmission path, said terminals being provided on respectively opposite sides of said driving integrated circuit.

8. An ink jet recording head according to claim 3, wherein said terminals that operate as input and output terminals are for input and output to the transmission path, said terminals being provided respectively on opposite sides of said driving integrated circuit.

9. An ink jet recording head according to claim 4, wherein said terminals that can function as input and output terminals are for input and output to the transmission path, said terminals being provided on respectively opposite sides of said driving integrated circuit.

10. An ink jet recording head according to claim 1, wherein said driving direction control means controls a driving direction of groups of a predetermined number of recording elements.

11. An ink jet recording head according to claim 1, wherein said recording elements are provided symmetrically with regard to said base plate to effect recordings from a same direction.

12. An ink jet recording head according to claim 1, wherein said driving integrated circuits are provided symmetrically with regard to said base plate to effect recording from a same direction.

13. An ink jet recording head comprising:

a pair of recording units provided on opposite sides of a base plate, each recording unit comprising:

a driving integrated circuit comprising a plurality of driving elements, a shift register provided for inputting bidirectionally signals, input/output terminals for serially transmitting a recording data signal and a control signal and for operating as both input and output terminals, and driving direction control means for driving said plurality of driving elements, according to an inputted driving direction control signal, bidirectionally in an order along an input direction of the driving direction control signal, heat generating elements communicating with said driving elements for generating heat energy utilized for recording, ink paths and emission ports, said emission ports communicating with said ink paths for emitting ink onto a recording medium, the ink being emitted by utilizing heat energy generated by said heat generating elements, and time divisional driving means for driving sequentially the plural driving elements in predetermined units of plural elements according to the input direction of the driving direction control signal, wherein ink droplets discharged in a same recording line from two corresponding emission ports of said pair of recording units are deposited onto substantially a same locus.

14. An ink jet recording head comprising:

a pair of recording units provided on opposite sides of a base plate, each recording unit comprising:

a driving integrated circuit comprising a plurality of driving elements, input/output terminals for serially transmitting recording data and a control signal, and for operating as both input terminals and output terminals, a driving signal controlling means for controlling said driving elements per a predetermined number of the driving elements according to the control signal transmitted serially from said input/output terminals, and driving direction control means for driving said plurality of driving elements, according to an inputted driving direction control signal, bidirectionally in an order along an input direction of the driving direction control signal, heat generating elements communicating with said driving elements for generating heat energy utilized for recording, ink paths and emission ports, said emission ports communicating with said ink paths for emitting ink onto a recording medium, the ink being emitted by utilizing heat energy generated by said heat generating elements, and time divisional driving means for driving sequentially the plural driving elements in predetermined units of plural elements according to the input direction of the driving direction control signal, wherein ink droplets discharged in a same recording line from two corresponding emission ports of said pair of recording units are deposited onto substantially a same locus.

* * * * *

UNITED STATES PATENT AND TRADEMARK OFFICE

CERTIFICATE OF CORRECTION

PATENT NO. : 5,608,431

DATED : March 4, 1997

INVENTOR(S) : HIDEAKI KISHIDA, ET AL.

It is certified that error appears in the above-indentified patent and that said Letters Patent is hereby corrected as shown below:

COLUMN 2

Line 54, "type 1" should read --type,--

COLUMN 4

Line 61, "apparatus" should read --apparently--.

COLUMN 7

Line 15, "method." should read --methods.--.

COLUMN 9

Line 13, "controlling driving of" should read --driving--.

Signed and Sealed this

Sixteenth Day of September, 1997

*Attest:*

*Attesting Officer*

Bruce Lehman

BRUCE LEHMAN

*Commissioner of Patents and Trademarks*